United States Patent [19]

Fricker

[11] 4,285,840

[45] Aug. 25, 1981

[54] DETERGENT COMPOSITIONS

[75] Inventor: René Fricker, Allschwil, Switzerland

[73] Assignee: Sandoz Ltd., Basel, Switzerland

[21] Appl. No.: 118,714

[22] Filed: Feb. 5, 1980

Related U.S. Application Data

[63] Continuation-in-part of Ser. No. 936,730, Aug. 25, 1978, abandoned.

[30] Foreign Application Priority Data

Jan. 25, 1980 [CH] Switzerland ..... 613/80
Jan. 25, 1980 [CH] Switzerland ..... 614/80

[51] Int. Cl.[3] ..... C11D 1/72; C11D 3/30; C11D 3/33; C11D 3/44

[52] U.S. Cl. ..... 252/546; 252/153; 252/171; 252/172; 252/173; 252/174.15; 252/174.21; 252/174.22; 252/358; 252/548; 252/DIG. 1; 252/DIG. 11; 252/DIG. 14

[58] Field of Search ..... 252/118, 153, 173, 174.15, 252/174.21, 174.22, 527, 529, 546, 548, DIG. 1, DIG. 11, DIG. 14, 358

[56] References Cited

U.S. PATENT DOCUMENTS

| | | | |
|---|---|---|---|
| 3,309,321 | 3/1967 | McMaster | 252/546 |
| 3,549,539 | 12/1970 | Mallows | 252/99 |
| 3,679,608 | 7/1972 | Aubert | 252/526 |
| 3,715,324 | 2/1973 | Hynes | 252/529 |
| 3,994,818 | 11/1976 | Loo | 252/171 |
| 4,020,016 | 4/1977 | Sokol | 252/546 |
| 4,060,496 | 11/1977 | Berliner | 252/171 |
| 4,075,118 | 2/1978 | Gault | 252/135 |

FOREIGN PATENT DOCUMENTS

| | | | |
|---|---|---|---|
| 870010 | 2/1979 | Belgium | 252/153 |
| 2260633 | 9/1975 | France . | |
| 1066407 | 4/1967 | United Kingdom | 252/118 |

*Primary Examiner*—Dennis L. Albrecht
*Attorney, Agent, or Firm*—Gerald D. Sharkin; Richard E. Vila; Joseph J. Borovian

[57] ABSTRACT

A detergent composition comprises an aqueous solution of the following components:

A: 3 to 6 parts by weight of a nitrilocarboxylic acid in free acid or salt form, B: 2 to 11 parts by weight of a higher ($C_{8-24}$) alkyl phenyl polyglycol ether having from 5 to 25 glycol residues, C: 5 to 15 parts by weight of an alkanolamine, D: 1 to 3 parts by weight of a block copolymer of propylene oxide and ethylene oxide of an average molecular weight from 1500 to 2500 and containing from 5 to 15% by weight of ethylene oxide end units, E: 0 to 3 parts by weight of a higher ($C_{8-14}$) alcohol, F: 0 to 1 parts by weight of a water-soluble silicone oil, and optionally one of the following solvents:

G: 10 to 40 parts by weight of an organic solvent based on aliphatic or aromatic hydrocarbon or chlorinated hydrocarbon or H: 5 to 20 parts by weight of a ($C_{13}$) alcohol or a water-soluble glycol.

16 Claims, No Drawings

DETERGENT COMPOSITIONS

The present application is a continuation-in-part of our co-pending application Ser. No. 936,730 filed on Aug. 25, 1978 now abandoned.

This invention relates to detergent compositions. The invention provides a detergent composition comprising an aqueous solution of the following active components:

A: 3 to 6 parts by weight of a nitrilocarboxylic acid in free acid or salt form

B: 2 to 11 parts by weight of a higher ($C_{8-24}$) alkyl phenyl polyglycol ether having from 5 to 25 glycol residues, C: 5 to 15 parts by weight of an alkanolamine, D: 1 to 3 parts by weight of a block copolymer of propylene oxide and ethylene oxide of an average molecular weight from 1500 to 2500 and containing from 5 to 15% by weight of ethylene oxide end units.

E: 0 to 3 parts by weight of a higher ($C_{8-14}$) alcohol,

F: 0 to 1 parts by weight of a water-soluble silicone oil, and optionally one of the following solvents:

G: 10 to 40 parts by weight of an organic solvent which is an aliphatic or aromatic hydrocarbon, a chlorinated hydrocarbon, or mixtures thereof, or H: 5 to 20 parts by weight of a ($C_{1-3}$) alcohol or a water-soluble glycol, provided that when solvent G is absent, component B is present in the amount of 2 to 6 parts by weight.

If either of components E or F is absent, then the other is preferably also absent. When components E and F are present, they are preferably present in the amount of 1 to 3 parts by weight of component E and 0.5 to 1 parts by weight of component F. If either of solvents G or H is present, then components E and F are preferably absent and the other solvent H or G is preferably absent.

The detergent composition contains the sum of the above 4–6 active components A to F in a total amount of from 15 to 30% by weight.

The nitrilocarboxylic acid of component A is preferably nitrilotriacetic acid [$N(CH_2COOH)_3$], or, most preferably, ethylenediaminetetraacetic acid (EDTA), in free acid or salt form, preferably in salt form. Suitable salts of nitrilocarboxylic acid are e.g. alkaline metal salts such as lithium, sodium or potassium, preferably sodium.

Preferred alkanolamines (component C) are mono-, di- and tri-ethanolamine, particularly monoethanolamine.

Component D is preferably a polymer containing an average of 28–32 propylene oxide units per molecule (average molecular weight 1650–1850) to which on average 8–12%, preferably 10% ethylene oxide units are co-polymerised. Such polymers are commercially available, for example under the Trade Mark PLURONIC, particularly PLURONIC L-61 and similar types.

Component E is preferably a branched-chain primary alcohol, for example a commercial mixture of saturated primary nonanols carrying 4 methyl groups (tetramethylnonanol).

Component F may be any water-soluble silicone oil such as are commercially available as antifoaming agents.

Preferred proportions of the components in the mixture (not taking into account the water present) are as follows. All percentages are by weight.

Preferred organic solvents (solvent G) include white spirit, trichlorethylene, toluene, chlorinated benzenes.

Solvent H is preferably ethanol, isopropanol or a glycol containing up to 6 carbon atoms e.g. hexyleneglycol.

Preferred proportions of the active components A to F in the mixture (not taking into account the water present or solvent G or H, if present,) are as follows. All percentages are by weight.

When no solvent G is present:

Component A—15–30%, more preferably 15–20%
Component B—15–30%, more preferably 15–20%
Component C—up to 60%, more preferably 40–50%
Component D—8–15%, more preferably 8–10%
Component E (when present)—8–15%, more preferably 8–10%
Component F (when present)—2–5%, more preferably 2–3%.

When solvent G is present:

Component A—10–25%, more preferably 13–18%
Component B—20–35%, more preferably 25–30%
Component C—up to 60%, more preferably 33–43%
Component D—5–15%, more preferably 5–10%
Component E (when present)—5–15%, more preferably 5–10%
Component F (when present)—2–5%, more preferably 2–3%.

The detergent composition may be prepared by adding the components and solvent, preferably in the order in which they are described above, to demineralised water and stirring until the mixture is homogeneous. In the case of a composition containing components A, B, C, D and optionally E and F together with solvent G, component B is added in two portions; 2 to 6 parts by weight of component B are added to the mixture of water and component A and then, after the addition of the other components C, D and optionally E and F, preferably in the order indicated above, a mixture of solvent G and 2 to 5 parts by weight of component B is added to the resulting mixture.

The detergent composition according to the invention may be used for example for the cleaning of apparatus, equipment and containers, particularly of glass or metal, as well as of surfaces such as walls, ceilings and floors, particularly of concrete floors in garages or workshops which are liable to be contaminated with oil. It may be used to remove deposits of dyestuffs, pigments, fat, protein, starch derivatives, oils, etc.

Compositions containing components A, B, C, D and optionally E and F together with solvent G are particularly indicated for cleaning surfaces contaminated with oil or tar, for example lane markers used for traffic control, garage floors and tunnels. Compositions containing components A, B, C, D and optionally E and F together with solvent H are more particularly suitable for cleaning glass surfaces and floors.

The detergent composition of the invention has an advantageous combination of strong cleaning power and low tendency to form a stable foam, especially when components E and F are present. The composition is free of phosphate ions and is environmentally acceptable.

For cleaning of moderately contaminated objects the aqueous (15–30%) detergent composition is suitably used in a concentration of 1–5% by weight in water, according to the nature of the contamination to be removed.

The following Examples, in which all parts and percentages are by weight, illustrate the invention.

EXAMPLE 1

To a container are added at room temperature 730 parts of demineralised water. The following components are then added singly in the order given, with continuous stirring. As each component is added, stirring is continued until mixing is complete before addition of the next component.

- 40 parts commercial EDTA in sodium salt form (powder)
- 110 parts commercial nonylphenol polyglycol ether containing 10 ethylene oxide units/mol, in 35% aqueous solution (corresponding to approximately 40 parts anhydrous substance)
- 100 parts monoethanolamine
- 20 parts PLURONIC L 61 (commercial ethylene oxidepropylene oxide block copolymer of MW approx. 1950, of which the polypropylene oxide part has MW approx. 1750).

After stirring for a further 10 minutes–1 hour (according to the size of the batch), the composition is ready for use.

EXAMPLE 2

Example 1 is repeated, except that the initial quantity of water used is 715 parts, and 100 parts of the nonylphenol polyglycol ether solution (35 parts anhydrous substance) is taken. To the resulting 4-component solution is then added with stirring 20 parts tetramethylnonanol and 5 parts water-soluble silicone oil (commercial antifoaming agent).

Stirring is continued until the resulting 6-component mixture is homogeneous.

EXAMPLE 3

Pipettes contaminated with acid-, dispersion-, direct- or basic dyestuffs are soaked overnight at room temperature in an aqueous medium containing from 1 to 5% (according to the degree of contamination) of the composition of Example 1. The contamination is then removed by rinsing with water.

Glass or metal dye beakers may be cleaned in the same manner.

EXAMPLE 4

Laboratory apparatus contaminated with dried blood, brain substance and albumin, which has been left to stand for a long period, is soaked in an aqueous medium containing from 3 to 5% (according to the degree of contamination) of the composition of Example 1, either for 2–3 hours at 80° or for 12 hours at room temperature. The apparatus is fit for reuse after rinsing with water.

EXAMPLE 5

Glassware, metal parts and plastic equipment contaminated with experimental agrochemical products such as insecticides, herbicides, fungicides and fertilisers can be reused after soaking in an aqueous medium containing from 1 to 5% (according to the degree of contamination) of the composition of Example 1.

EXAMPLE 6

Apparatus used in a clinical chemistry laboratory, and contaminated with blood, urine, enzymatic compounds or test stains, is soaked in an aqueous medium containing 1 to 5% of the composition of Example 1 at room temperature or at 40°–80° for 2–4 hours. After rinsing well with water the apparatus is ready for reuse.

EXAMPLE 7

Metal and glass laboratory apparatus, contaminated with old deposits of dried blood and dyestuffs, can be cleaned in an automatic dishwashing machine at 90° with an aqueous medium containing from 2–50 g/l of the composition of Example 2, without problems of excessive foaming.

EXAMPLE 8

To a container are added at room temperature 730 parts of demineralised water. The following components are then added singly in the order given, with continuous stirring. As each component is added, stirring is continued until mixing is complete before addition of the next component.

- 40 parts commercial EDTA in sodium salt form (powder)
- 110 parts commercial nonylphenol polyglycol ether containing 10 ethylene oxide units/mol, in 35% aqueous solution (corresponding to approximately 40 parts anhydrous substance)
- 100 parts monoethanolamine
- 20 parts PLURONIC L 61 (commercial ethylene oxidepropylene oxide block copolymer of MW approx. 1950, of which the polypropylene oxide part has MW approx. 1750).

To 90 parts of the resulting composition is then added with stirring 10 parts ethanol. After stirring for a further 10 minutes-1 hour, (according to the size of the bath), the composition is ready for use.

EXAMPLE 9

Example 1 is repeated, except that 10 parts hexyleneglycol are added to the 90 parts of the 4-component composition instead of 10 parts ethanol.

EXAMPLE 10

Dirty window glasses are treated with the composition of Example 8. After a short soaking, the glass is rinsed water. A transparent clean glass is obtained.

EXAMPLE 11

Floors contaminated with black rubber sole prints, graphite and tar spots are treated with the composition of Example 9. After rinsing with water, the floors are clean.

EXAMPLE 12

To a container are added at room temperature 730 parts of demineralised water. The following components are then added singly in the order given, with continuous stirring. As each component is added, stirring is continued until mixing is complete before addition of the next component.

- 40 parts commercial EDTA in sodium salt form (powder)
- 110 parts commercial nonylphenol polyglycol ether containing 10 ethylene oxide units/mol, in 35% aqueous solution (corresponding to approximately 40 parts anhydrous substance)
100 parts monoethanolamine
20 parts PLURONIC L 61 (commerical ethylene oxidepropylene oxide block copolymer of MW approx. 1950, of which the polypropylene oxide part has MW approx. 1750).

To 70 parts of the resulting composition are then added with stirring 20 parts white spirit and 10 parts nonylphenol polyglycol ether as used above. Stirring is continued until the composition is homogeneous.

EXAMPLE 13

Traffic marking devices contaminated with fat, tar and dust are treated with the composition of Example 12 and then rinsed with water. The contamination is readily removed.

EXAMPLE 14

A tunnel road contaminated with oil, dust and rubber prints is treated with the composition of Example 12. After soaking for several hours, the road is sprayed with water. The road is free of contamination and ready for the traffic.

By following the same procedure, landing strips and runways may be cleaned.

What is claimed is:

1. An aqueous detergent composition comprising from 70% to 85% water and, as the active component thereof, from 15% to 30% of a mixture consisting essentially of:

(A) 3 to 6 parts by weight of nitrilotriacetic acid or ethylenediamine tetraacetic acid in free acid or salt form;
(B) 2 to 11 parts by weight of a nonylphenol polyglycol ether having an average of 8 to 12 glycol units per molecule;
(C) 5 to 15 parts by weight of mono-, di- or tri- ethanolamine;
(D) 1 to 3 parts by weight of a block copolymer of propylene oxide and ethylene oxide containing an average of 28 to 32 propylene oxide units per molecule to which an average of 8 to 12% by weight of ethylene oxide units are copolymerized;
(E) 0 to 3 parts by weight of a $C_8$ to $C_{14}$ branched chain, primary alcohol; and
(F) 0 to 1 parts by weight of a water-soluble, silicone oil, and, as an optional solvent component thereof, from:

(G) 10 to 40 parts, based on the total weight of the aqueous mixture of active components, of an aliphatic or aromatic hydrocarbon, a chlorinated hydrocarbon, or a mixture thereof; or
(H) 5 to 20 parts, based on the total weight of the aqueous mixture of active components, of a $C_1$ to $C_3$ alcohol or a water-soluble glycol, or a mixture of solvent components (G) and (H), with the proviso that when solvent component (G) is absent, active component (B) is present in an amount of from 2 to 6 parts by weight.

2. A detergent composition according to claim 1 wherein solvent components (G) and (H) are absent.

3. A detergent composition according to claim 1 wherein active components (E) and (F) are absent.

4. A detergent composition according to claim 1 wherein active component (B) is present in an amount of from 2 to 6 parts by weight, active components (E) and (F) are absent and solvent component (H) is present.

5. A detergent composition according to claim 1 wherein active components (E) and (F) are absent and solvent component (G) is present.

6. A detergent composition according to claim 2 wherein active components (E) and (F) are absent.

7. A detergent composition according to claim 1 wherein active component (B) is present in an amount of from 2 to 6 parts by weight, active component (E) is present in an amount of from 1 to 3 parts by weight, active component (F) is present in an amount of from 0.5 to 1 part by weight and solvent components (G) and (H) are absent.

8. A detergent composition according to claim 1 wherein solvent component (G) is absent and the active components (A) to (F) are present in the following proportions by weight, excluding the water present and solvent component (H) if present:

component (A): 15–30%;
component (B): 15–30%;
component (C): up to 60%;
component (D): 8–15%;
component (E): 8–15%; and
component (F): 2–5%.

9. A detergent composition according to claim 8 wherein active components (A) to (F) are present in the following proportions by weight:

component (A): 15–20%;
component (B): 15–20%;
component (C): 40–50%;
component (D): 8–10%;
component (E): 8–10%; and
component (F): 2–3%.

10. A detergent composition according to claim 1 wherein solvent component (G) is present and the active components (A) to (F) are present in the following proportions by weight, excluding the water present, solvent component (G) and solvent component (H), if present:

component (A): 10–25%;
component (B): 20–35%;
component (C): up to 60%;
component (D): 5–15%;
component (E): 5–15%; and
component (F): 2–5%.

11. A detergent composition according to claim 10 wherein active components (A) to (F) are present in the following proportions by weight:

component (A): 13–18%;
component (B): 25–30%;
component (C): 33–43%;
component (D): 5–10%;
component (E): 5–10%; and
component (F): 2–3%.

12. A detergent composition according to claim 1 wherein active component (A) is the sodium salt of ethylenediamine tetraacetic acid, active component (B) is a nonylphenol polyglycol ether having an average of 10 glycol units per molecule, active component (C) is monoethanolamine, active component (E) is tetramethylnonanol, solvent component (G) is selected from the group consisting of white spirit, trichlorethylene, toluene and chlorinated benzene, and solvent component (H) is selected from the group consisting of ethanol, isopropanol and hexyleneglycol.

13. A process for preparing an aqueous detergent composition according to claim 1 comprising adding the active components singly and in the order (A) to (F) and, optionally, solvent components (G) or (H), or a mixture thereof to demineralized water and stirring the resultant mixture until it is homogeneous.

14. A process according to claim 13 comprising, where solvent (G) is present, adding active component (A), 2 to 6 parts by weight of active component (B), the other active components, and a mixture of solvent component (G) and 2 to 5 parts by weight of active component (B) to demineralized water and stirring the resultant mixture until it is homogeneous.

15. In a process for cleaning contaminated articles or surfaces comprising applying an aqueous detergent composition to said contaminated articles or surfaces, allowing the contaminated articles or surfaces to remain in contact with said aqueous solution for a time sufficient to decontaminate said articles or surfaces and rinsing the thus-treated articles or surfaces with water to remove the contamination, the improvement wherein the aqueous detergent composition of claim 1 is applied to the contaminated articles or surfaces.

16. A process according to claim 15 wherein from 1 to 5% by weight of the detergent composition is applied to the contaminated articles or surfaces.

* * * * *

UNITED STATES PATENT AND TRADEMARK OFFICE

CERTIFICATE OF CORRECTION

PATENT NO. : 4,285,840

DATED : August 25, 1981

INVENTOR(S) : Rene Fricker

It is certified that error appears in the above-identified patent and that said Letters Patent is hereby corrected as shown below:

Title page, left-hand column, Item [30]; in addition to the Swiss priority applications set forth, please insert the following:

-- August 29, 1977[CH] Switzerland 10499/77
March 10, 1978[CH] Switzerland 2644/78 --."

Column 1, line 5; before "application, delete "our copending".

Signed and Sealed this

*Twenty-sixth* Day of *July 1983*.

[SEAL]

*Attest:*

GERALD J. MOSSINGHOFF

*Attesting Officer*

*Commissioner of Patents and Trademarks*